US008389466B2

(12) United States Patent
Panten et al.

(10) Patent No.: US 8,389,466 B2
(45) Date of Patent: Mar. 5, 2013

(54) USE OF CARBOXYLIC ACID ESTERS AS A FRAGRANCE SUBSTANCE

(75) Inventors: Johannes Panten, Höxter (DE); Egon Oelkers, Bevern (DE); Joachim Correll, Sao Paolo (BR); Pierre Kurzenne, Bois Colombes (FR)

(73) Assignee: Symrise AG, Holzminden (DE)

( * ) Notice: Subject to any disclaimer, the term of this patent is extended or adjusted under 35 U.S.C. 154(b) by 116 days.

(21) Appl. No.: 12/936,285

(22) PCT Filed: Apr. 3, 2009

(86) PCT No.: PCT/EP2009/054013

§ 371 (c)(1), (2), (4) Date: Dec. 10, 2010

(87) PCT Pub. No.: WO2009/124888

PCT Pub. Date: Oct. 15, 2009

(65) Prior Publication Data

US 2011/0104092 A1 May 5, 2011

Related U.S. Application Data

(60) Provisional application No. 61/042,979, filed on Apr. 7, 2008, provisional application No. 61/046,019, filed on Apr. 18, 2008.

(51) Int. Cl.
*A61Q 13/00* (2006.01)

(52) U.S. Cl. ..... 512/26

(58) Field of Classification Search ..... 512/26
See application file for complete search history.

(56) References Cited

U.S. PATENT DOCUMENTS 3,093,681 A 6/1963 Eichmann et al.
4,613,457 A 9/1986 Blosl et al.

OTHER PUBLICATIONS

Hilker, M.; Schulz, S., "Composition of Larval Secretion of Chrysomela lapponica (Coleoptera, Chrysomelidae) and its Dependence on Host Plant," Journal of Chemical Ecology, vol. 20, No. 5, 1994, pp. 1075-1093, XP008108095.

Termonia, A.; Pasteels, J.: "Larval chemical defence and evolution of host shifts in Chrysomela leaf beetles," Chemoecology, vol. 9, No. 1, 1999, pp. 1075-1093, XP002535470.

*Primary Examiner* — Ling Choi
*Assistant Examiner* — Lanee Reuther
(74) *Attorney, Agent, or Firm* — Novak Druce Connolly Bove + Quigg LLP

(57) ABSTRACT

A description is provided of the use of certain carboxylic acid esters as a fragrance substance, preferably as a fragrance substance for conveying, modifying and/or intensifying one, two or all the fragrance notes fruity and green, preferably both the fragrance notes fruity and green.

15 Claims, No Drawings

USE OF CARBOXYLIC ACID ESTERS AS A FRAGRANCE SUBSTANCE

CROSS REFERENCE TO RELATED APPLICATIONS

This application is a National Phase filing under 35 U.S.C. §371 of International Application No. PCT/EP2009/054013, filed Apr. 3, 2009, which claims priority to U.S. Provisional Patent Application No. 61/042,979, filed Apr. 7, 2008 and U.S. Provisional Patent Application No. 61/046,019, filed Apr. 18, 2008. The entire contents of each of the above-applications are incorporated herein by reference.

The present invention concerns the use of specific carboxylic acid esters of formula (I) as a fragrance substance, especially for conveying, modifying and/or intensifying the fruity (in particular pear and pineapple) and green fragrance notes.

(I)

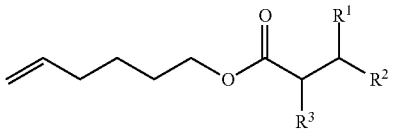

A further facet of the invention concerns fragrance substance preparations, containing an effective quantity of one or more compounds of formula (I) as well as one or more further fragrance substances, and a corresponding method for manufacturing these fragrance substance preparations.

A further facet of the present invention concerns perfumed articles containing one or more compounds of formula (I) or a corresponding fragrance substance preparation.

The invention also concerns the use of compounds of formula (I) or corresponding fragrance substance preparations to provide (a) hair or (b) textile fibres with a fruity and green smell along with corresponding methods.

Furthermore, the invention concerns the use of compounds of formula (I) as a means of increasing the substantivity and/or retention of a fragrance substance preparation.

For further properties of the compounds to be used according to the invention, the fragrance substance preparations, perfumed articles, methods and applications according to the invention see the following description and the attached patent claims.

Despite the existence of a large number of fragrance substances, the perfume industry continues to have a general need for new fragrance substances, which in addition to their primary, that is to say olfactory, characteristics also have positive secondary characteristics, such as, for example, increased stability under certain usage conditions, a higher yield or a better adhesion, or which through synergic effects with other fragrance substances lead to improved sensory profiles.

The perfume industry also has a basic need for additional fragrance substances, which are suitable for the manufacture of fragrance substance preparations or perfumed articles. Specifically, there is a need for fragrance substances, which thanks to the abovementioned technical characteristics lead to greater utility in fragrance substance preparations. Thus, for example, through the use of fragrance substances with a better sensory profile the quantities used and the number of fragrance substances in corresponding formulations can be optimized and/or minimized, leading to sustainable resource preservation in the perfuming of consumer and non-durable goods.

Thus the perfume industry has a particular need for further fragrance substances with better sensory profiles.

At the same time the perfume industry has a particular need for fragrance substances with fruity and green notes. In the context of the present text this means a smell which is similar to the smell of naturally occurring fruits such as pineapples and/or pears or their components, but which has an additional green note.

The primary object of the present invention was to provide a new fragrance substance with a fruity and additionally a green fragrance note, as well as corresponding fragrance substance preparations. Moreover, these fragrance substances or the fragrance substance preparations should have the above-mentioned technical characteristics or advantages.

In the context of the present text a fragrance substance is in the wider sense any substance which generates, that is to say conveys, an olfactory impression, or which changes, that is to say modifies or intensifies, the olfactory cognition of another substance on the basis of its inherent smell.

A preparation in the context of the present text is a mixture of various substances, which is generated according to a recipe or formulation by following a specified method from the corresponding substances. Such preparations are (in particular with regard to their composition) deliberately brought about and are based on a formulation; they do not occur naturally as a mixture or mixtures (of substances) as, for example, the secretions of certain animal species do.

A fragrance substance preparation is a preparation which contains two or more fragrance substances, wherein the respective components of the fragrance substances are adjusted according to a recipe.

Furthermore, the present invention should provide corresponding advantageous applications of the fragrance substance.

In the context of the invention fragrance substances should in particular be provided which can be advantageously used in fragrance substance preparations of the exotic fruit type.

Further task definitions upon which the present invention is based can be inferred from the following statements and the attached patent claims.

According to a primary facet the present invention concerns the use of a compound of formula (I)

(I)

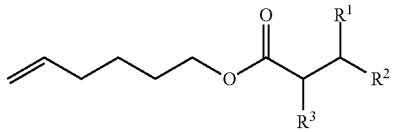

wherein $R^1$, $R^2$, $R^3$ are selected independently of one another from the group comprising H, methyl, ethyl and propyl, as fragrance substance.

Compounds of formula (I) are especially suited for use as a fragrance substance for conveying, modifying and/or intensifying one, or both, of the fruity and green fragrance notes, preferably both the fruity and green fragrance notes.

The fragrance notes described in the context of the present text are also to be assigned the corresponding notes of an after-smell, i.e. compounds of formula (I) are collectively suited to use as a fragrance substance for conveying, modifying and/or intensifying one, more or all the above-mentioned fragrance notes and/or an after-smell with one or more of the above notes. The fragrance notes described in the further facets of the present invention explained in the following are likewise to be assigned to the corresponding notes of an after-smell.

Of the compounds of formula (I) particular preference is for the use of hex-5-enyl-2-methyl butyrate, the structural formula of which is shown below:

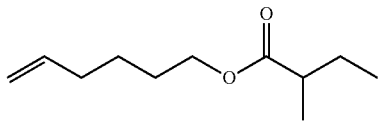

Thus in formula (I) the following preferably applies: $R^1$ is hydrogen and $R^2$ and $R^3$ are in each case methyl. Hex-5-enyl-2-methyl butyrate is particularly well suited to conveying, modifying and/or intensifying both, but at least one, of the fruity (in particular pineapples and/or pears) and green fragrance notes. Hex-5-enyl-2-methyl butyrate is therefore particularly well suited to corresponding use for conveying, modifying and/or intensifying both the fruity (in particular pineapples and/or pears) and green fragrance notes.

The compound hex-5-enyl-2-methyl butyrate (CAS Number: 155514-23-1) is already known.

In the publications *Journal of Chemical Ecology* 1994, 20(5), 1075-93 and *Chemoecology* 1999, 9(1), 13-23 hex-5-enyl-2-methyl butyrate is described as a component of the secretion of certain types of larvae.

The first publication shows the results of investigations into the composition of the secretions from the exocrine glands of the larvae of *Chrysomela lapponica* according to the host plant (birch or willow). The secretions from the larvae following purposeful provocation were collected using a syringe and immediately investigated through a combination of gas chromatography and mass spectrometry methods (carrier gas: helium). In further investigations the secretions were dissolved in absolute diethyl ether and reduced with $LiAlH_4$. The compound hex-5-enyl-2-methyl butyrate was detectable, in both cases (both birch and willow host plants) in the secretion of the *Chrysomela lapponica* larvae.

The second publication, *Chemoecology* 1999, 9(1), 13-23, describes the secretions of the larvae of various types from the group *Chrysomela interrupra*. In order to determine the composition the secretions under investigation were dissolved in n-hexane and the n-hexane extracts investigated by a combination of the gas chromatography and mass spectrometry methods. The compound hex-5-enyl-2-methyl butyrate was detected in the secretions of larvae of the *Chrysomela knabi, Chrsysomela walshi, Chrysomela falsa* or *Chrysomela* sp types with *Salix caprea* as the host plant and in the secretions of larvae of the *Chrysomela mainensis interna* type with *Alnus rugosa* as the host plant.

The composition of the secretions described in the abovementioned publications varies according to the species of the *Chrysomela* larvae and the host plant. All the secretions described in the abovementioned publications, containing hex-5-enyl-2-methyl butyrate, contained the following components (even if in varying proportions): (E)-8-(2-methylbutyryloxy)linalool, (E)-8-isobutyryloxylinalool, (Z)-3-hexenyl-2-methyl butyrate, (Z)-3-hexenyl-isobutyrate, 2-methyl butyric acid, isobutyric acid, 2-phenylethyl-2-methyl butyrate, 2-phenylethyl-isobutyrate, benzyl-2-methyl butyrate, benzyl isobutyrate.

The larval secretions described in the above publications are not fragrance substance preparations in the sense of the present text, since they occur naturally and are therefore not purposefully, i.e. intentionally, generated according to a recipe. According to the abovementioned publications, solutions prepared for the purposes of the analyses or extracts of these secretions are likewise not fragrance substance preparations in the sense of the present text, since the proportion of the fragrance substances contained is determined by the natural composition of the secretion, and is therefore not set by a recipe.

In the abovementioned publications nothing is said of the sensory character of hex-5-enyl-2-methyl butyrate itself.

As will be clear from that stated below, it was particularly surprising that compounds of formula (I) are suitable as fragrance substances in the sense of the applications described above. The fact that these compounds, especially hex-5-enyl-2-methyl butyrate, have a highly expressive fruity and green smell, is particularly surprising, since compounds with hex-5-enyl groups have not previously been used as fragrance substances and have not to date been in evidence in this form. As a result there were no sensory empirical values on this class of compounds. The typical fragrance substances, which convey the olfactory impression of pineapple (typically: allyl esters), pears (ethyl-2,4-decadienoate) and green (cis-hex-3-enyl-ester), are clearly structurally different from the substances according to the invention. Normally a change in functionalities, even for otherwise structurally similar compounds leads to distinctly different olfactory characteristics. The following list provides examples of selected scent descriptions of the abovementioned structurally similar compounds (source: H. Surburg and J. Panten, Common Fragrance and Flavor Materials, 5$^{th}$ Ed., Wiley-VCH, Weinheim 2006):

allyl-2-isoamyloxyacetate is an important fragrance substance, having a fruity (pineapple) smell:

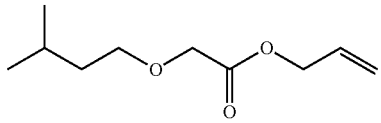

ethyl-2-trans-4-cis-decadienoate was identified in pears and is a fragrance substance, which embodies the typical smell of Williams pears:

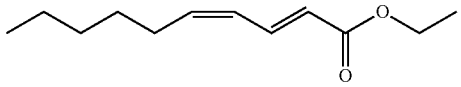

cis-3-hexenyl-isobutyrate ((Z)-3-hexenyl-isobutyrate) has been found in green mint and is a fragrance substance which has a fruity-green smell. In perfumery cis-3-hexenyl-isobutyrate is used in flower themes in order to convey freshness. (S. Arctander, Perfume and Flavor Chemicals, No. 17, 1969, Montclair, N.J. (USA)).

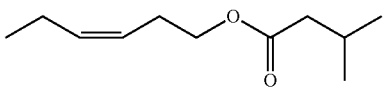

As a comparison will show, none of the esters contain a hex-5-enyl group and nor do the unsaturated alcohol residues cause a different smell.

Compounds of formula (I) are suited to the application according to the invention not only because of the fragrance notes described, but also because of their olfactory and material characteristics, such as solubility in the usual cosmetic solvents, compatibility with the usual other components of such products, etc. In addition, the toxicological harmlessness of the compounds of formula (I) underlines the particular suitability of the compound for the other purposes mentioned above and below. Further positive characteristics of the compound to be used according to the invention and corresponding mixtures containing this compound are described further on in connection with applications according to the invention.

Fruity and green fragrance notes are used in very many fragrance substance and perfume preparations, in particular, for example, in exotic fruit scent themes.

The surprising fruity and green olfactory profile (in fragrance substance and perfume preparations) of compounds of formula (I), especially hex-5-enyl-2-methyl butyrate, contributes to the particular suitability of this fragrance substance for corresponding applications in these scent themes. That is to say that, because of the known olfactory and material characteristics, compounds of formula (I), in particular hex-5-enyl-2-methyl butyrate are particularly well-suited for use as a component of a fragrance substance preparation of the exotic fruit type, i.e. they are particularly well-suited to being combined with one or more fragrance substances, which are typically used in fragrance substance preparations of the exotic fruit type. The term "exotic fruit" describes the smell that is reminiscent of exotic, in particular tropical, fruit such as pineapples, mango, papaya, durian and so on, or of a combination of several exotic fruits.

Fragrance substance preparations of the exotic fruit type contain preferably in addition to one or more compounds of formula (I), preferably hex-5-enyl-2-methyl butyrate or a mixture of hex-5-enyl-2-methyl butyrate with one or more further compounds of formula (I), one or more fragrance substances from the group comprising ethyl methyl butyrate (ethyl-2-methyl butyrate); hexenyl butyrate ((Z)-3-hexenyl butyrate); ethyl butyrate; methyl methyl butyrate (methyl-2-methyl butyrate); gamma-hexadecalactone; gamma-octalactone; allyl capronate; thiomenthanone; sulfurol; hexyl isobutyrate; ethyl acetate; isoamyl acetate; isovaleraldehyde; ethyl capronate; furaneol; 2-methyl-4-propyl-1,3-oxathiane (cis-2-methyl-4-propyl-1,3-oxathiane).

In connection with fragrance substance preparations of the exotic fruit type in particular, a large number of the positive characteristics of hex-5-enyl-2-methyl butyrate are particularly pronounced. The example described further on of an exotic fruit scent theme (see Example 2) demonstrates in a clear fashion the olfactory effect and the positive characteristics of hex-5-enyl-2-methyl butyrate (as an example for all compounds of formula (I)). Further preferences of the present invention can thus be found further on.

These preferred embodiments should not in any way restrict the facets of the present invention. In fact the compounds of formula (I) to be used according to the invention as a fragrance substance, according to a further facet of the invention, can be contained quite generally in fragrance substance preparations. Fragrance substance preparations according to the invention contain an effective quantity of one or more compounds of formula (I) along with one or more further fragrance substances.

Accordingly, the present invention also concerns a fragrance substance preparation, containing one or more compounds of formula (I), preferably hex-5-enyl-2-methyl butyrate along with one, two: three or more further fragrance substances, wherein the ratio of the weight of the total quantity of compounds of formula (I) to the total quantity of further fragrance substances is preferably in the range 1:1000 to 1:0.5, preferably in the range 1:700 to 1:1, and particularly preferably in the range 1:500 to 1:10.

Here it is preferable if a fragrance substance preparation according to the invention contains a quantity of one or more compounds of formula (I), preferably a quantity of hex-5-enyl-2-methyl butyrate or a mixture of hex-5-enyl-2-methyl butyrate and one or more further compounds of formula (I), sufficient to convey, modify and/or intensify one or preferably both of the fragrance notes fruity and green (organoleptically effective quantity).

As our own investigations have shown, the fragrance substance preparations described above that are particularly suitable for the purposes of the present invention, are those containing a total quantity of compounds of formula (I), preferably hex-5-enyl-2-methyl butyrate on its own or in the form of a mixture of hex-5-enyl-2-methyl butyrate and one or more further compounds of formula (I) in a range of between 0.01 and 65% by weight, preferably of between approximately 0.1 and approximately 50% by weight, preferably of between approximately 0.5 and approximately 30% by weight and particularly preferably of between approximately 0.5 and approximately 25% by weight, in relation to the total quantity of the fragrance substance preparation.

In a mixture with other fragrance substances the compounds of formula (I) to be used according to the invention, in particular hex-5-enyl-2-methyl butyrate, accordingly in the smallest doses of fragrance substance preparation are able to convey a desired smell note as described above.

As already mentioned above, it is also preferable if the fragrance substance preparations according to the invention (mentioned above and explained further below) contain a quantity of compounds of formula (I), preferably hex-5-enyl-2-methyl butyrate, which is sufficient to convey, modify and/or intensify one or more of the fragrance notes fruity and green and/or one, or both after-smell notes, fruity and green.

Particular preference is for fragrance substance preparations or perfumed articles, containing a quantity of hex-5-enyl-2-methyl butyrate, sufficient to convey, modify and/or intensify a fruity and green smell note.

All mixtures described in the *Journal of Chemical Ecology* 1994, 20(5), 1075-93 and *Chemoecology* 1999, 9(1), 13-23, publications which contain hex-5-enyl-2-methyl butyrate and at least one further fragrance substance, are not however the subject matter of the present invention.

The following mixtures in particular are not fragrance substance preparations according to the invention:

- mixtures containing larval secretions of *Chrysomela lapponica* with *Betula pendula* or *Salix fragilis* as the host plant or identically composed preparations in absolute diethyl ether;
- mixtures containing larval secretions of *Chrysomela lapponica* with *Betula pendula* or *Salix fragilis* as the host plant or identically composed preparations in absolute diethyl ether with the addition of $LiAlH_4$
- solutions or extracts of larval secretions of the *Chrysomela knabi, Chrsysomela walshi, Chrysomela falsa* or *Chrysomela* sp types with *Salix caprea* as the host plant or identically composed preparations in n-hexane
- solutions or extracts of larval secretions of the *Chrysomela mainensis interna* type with *Alnus rugosa* as the host plant or identically composed preparations in absolute diethyl in n-hexane.

Also not the subject matter of the present invention are mixtures whose composition is identical to one of the following larval secretions:

larval secretions of *Chrysomela lapponica* with *Betula pendula* or *Salix fragilis* as the host plant larval secretions of the *Chrysomela knabi, Chrsysomela walshi, Chrysomela falsa* or *Chrysomela* sp type with *Salix caprea* as the host plant larval secretions of the *Chrysomela mainensis interna* type with *Alnus rugosa* as the host plant.

The fragrance substance preparation according to the invention is preferably not a solution and not an extract of one of the abovementioned larval secretions or a preparation whose composition is identical to one of the abovementioned larval secretions. The fragrance substance preparations according to the invention preferably contain none of the abovementioned larval secretions and also no preparations with an identical composition.

The preparations according to the invention preferably do not at the same time contain, apart from hex-5-enyl-2-methyl butyrate, all or at least not at the same time 6, 7, 8 or 9 of the following compounds: (E)-8-(2-methylbutyryloxy)linalool, (E)-8-isobutyryloxylinalool, (Z)-3-hexenyl-2-methyl butyrate, (Z)-3-hexenyl-isobutyrate, 2-methyl butyric acid, isobutyric acid, 2-phenyl ethyl-2-methyl butyrate, 2-phenyl ethyl-isobutyrate, benzyl-2-methyl butyrate, benzyl isobutyrate, (which (in various proportions) are contained in all the abovementioned larval secretions).

Also not preferred are preparations according to the invention, containing alongside each other the following compounds: isobutyric acid, 2-methyl butyric acid, (E)-8-(2-methyl butyryloxy)linalool, (E)-8-isobutyryloxylinalool, (Z)-3-hexenyl-2-methyl butyrate, 2-phenylethyl-2-methyl butyrate, benzyl-2-methyl butyrate.

As described, the fragrance substance preparations according to the invention contain one or more further fragrance substances. According to a further facet of the present invention fragrance substance preparations according to the invention that are particularly preferred are those containing at least one further fragrance substance, preferably 2, 3, 4, 5, 6, 7, 8 or more further fragrance substances, wherein the one or more further fragrance substances are selected from the group consisting of:

alpha-hexylcinnamaldehyde, 2-phenoxyethyl isobutyrate (Phenirate[1]), dihydromyrcenol (2,6-dimethyl-7-octen-2-ol), methyl dihydrojasmonate (preferably with a content of cis-isomers of more than 60% by weight) (Hedione[9], Hedione HC[9]), 4,6,6,7,8,8-hexamethyl-1,3,4,6,7,8-hexahydrocyclopenta[g]benzopyrane (Galaxolid[3]), tetrahydrolinalool (3,7-dimethyloctan-3-ol), ethyllinalool, benzyl salicylate, 2-methyl-3-(4-tert-butyl-phenyl) propanal (Lilial[2]), cinnamic alcohol, 4,7-methano-3a,4,5,6,7,7a-hexahydro-5-indenylacetate and/or 4,7-methano-3a,4,5,6,7,7a-hexahydro-6-indenylacetate (Herbaflorat[1]), citronellol, vanillin, linalyl acetate, styrolyl acetate (1-phenyl ethyl acetate), octahydro-2,3,8,8-tetramethyl-2-acetonaphthone and/or 2-acetyl-1,2,3,4,6,7,8-octahydro-2,3,8,8-tetramethylnaphtalene (Iso E Super[3]), hexylsalicylate, 4-tert.-butyl cyclohexyl acetate (Oryclone[1]), 2-tert.-butyl cyclohexyl acetate (Agrumex HC[1]), alpha-ionone (4-(2,2,6-trimethyl-2-cyclohexen-1-yl)-3-buten-2-one). n-alpha-methylionone, alpha-isomethylionone, coumarin, terpinyl acetate, 2-phenylethyl alcohol, 4-(4-hydroxy-4-methylpentyl)-3-cyclohexene carboxaldehyde (Lyral[3]), alpha-amyl cinnamaldehyde, ethylene brassylate, (E)- and/or (Z)-3-methylcyclopentadec-5-enone (Muscenon[9]), 15-pentadec-11-enolide and/or 15-pentadec-12-enolide (Globefide), 15-cyclopentadecanolide (Macrolide[1]), 1-(5,6,7,8-tetrahydro-3,5,5,6,8,8-hexamethyl-2-naphthalenyl) ethanone (Tonalid[10]), 2-isobutyl-4-methyltetrahydro-2H-pyran-4-ol (Florol[9]), 2-ethyl-4-(2,2,3-trimethyl-3-cyclopenten-1-yl)-2-buten-1-ol (Sandolen[1]), cis-3-hexenyl acetate, trans-3-hexenyl acetate, trans-2,cis-6-nonadienol, 2,4-dimethyl-3-cyclohexene carboxaldehyde (Vertocitral[1]), 2,4,4,7-tetramethyl-oct-6-en-3-one (Claritone[1]), 2,6-dimethyl-5-hepten-1-al (Melonal[2]), borneol, 3-(3-isopropylphenyl)butanal (Florhydral[2]), 2-methyl-3-(3,4-methylene dioxyphenyl) propanal (Helional[3]), 3-(4-ethylphenyl)-2,2-dimethyl propanal (Florazon[1]), 7-Methyl-2H-1,5-benzodioxepin-3(4H)-one (Calone 1951[5]), 3,3,5-trimethyl cyclohexyl acetate (preferably with a content of cis-isomers of 70% by weight or more) and 2,5,5-trimethyl-1,2,3,4,4a,5,6,7-octahydronaphthalin-2-ol (Ambrinol S[1]). The abovementioned fragrance substances in the context of the present invention are accordingly preferably combined with hex-5-enyl-2-methyl butyrate. Where trade names are indicated above, these relate to the following sources:

[1]Trade name of Symrise GmbH, Germany;

[2]Trade name of Givaudan AG. Switzerland;

[3]Trade name of International Flavors & Fragrances Inc., USA;

[5]Trade name of Danisco Seillans S.A., France;

[9]Trade name of Firmenich S.A., Switzerland;

[10]Trade name of PFW Aroma Chemicals B.V., The Netherlands.

Further fragrance substances, with which the hex-5-enyl-2-methyl butyrate to be used according to the invention can be advantageously combined can be found in, for example, S. Arctander, Perfume and Flavor Chemicals, Vol. I and II, Montclair, N.J., 1969, self-published or H. Surburg and J. Panten, Common Fragrance and Flavor Materials, 5th. Ed., Wiley-VCH, Weinheim 2006. In detail the following are mentioned:

extracts from natural raw materials such as essential oils, concretes, absolutes, resins, resinoids, balsams, tinctures such as for example ambergris tincture; amyris oil; angelica seed oil; angelica root oil; aniseed oil; valerian oil; basil oil; tree moss absolute; bay oil; armoise oil; benzoe resinoid; bergamot oil; beeswax absolute; birch tar oil; bitter almond oil; savory oil; buchu leaf oil; cabreuva oil; cade oil; calamus oil; camphor oil; cananga oil; cardamom oil; cascarilla oil; cassia oil; cassie absolute; castoreum absolute; cedar leaf oil; cedar wood oil; cistus oil; citronella oil; lemon oil; copaiba balsam; copaiba balsam oil; coriander oil; costus root oil; cumin oil; cypress oil; davana oil; dill weed oil; dill seed oil; eau de brouts absolute; oak moss absolute; elemi oil; estragon oil; eucalyptus citriodora oil; eucalyptus oil; fennel oil; fir needle oil; galbanum oil; galbanum resin; geranium oil; grapefruit oil; guaiacwood oil; gurjun balsam; gurjun balsam oil; helichrysum absolute; helichrysum oil; ginger oil; iris root absolute; iris root oil; jasmine absolute; calamus oil; blue camomile oil; Roman camomile oil; carrot seed oil; cascarilla oil; pine needle oil; spearmint oil; caraway oil; labdanum oil; labdanum absolute; labdanum resin; lavandin absolute; lavandin oil; lavender absolute; lavender oil; lemon-grass oil; lovage oil; lime oil distilled; lime oil expressed; linaloe oil; Litsea cubeba oil; laurel leaf oil; mace oil; marjoram oil; mandarin oil; massoi (bark) oil; mimosa absolute; ambrette seed oil; musk tincture; clary sage oil; nutmeg oil; myrrh absolute; myrrh oil; myrtle oil; clove leaf oil; clove bud oil; neroli oil; olibanum absolute; olibanum oil; opopanax oil; orange flower absolute; orange oil; origanum oil; palmarosa oil; patchouli oil; perilla oil; Peru balsam oil; parsley leaf oil; parsley seed oil; petitgrain oil; peppermint oil; pepper oil; pimento oil; pine oil; pennyroyal oil; rose absolute; rosewood oil; rose oil; rosemary oil; Dalmatian sage oil; Spanish sage oil; sandalwood oil; celery seed oil; spike-lavender oil; star anise oil; storax oil; tagetes oil; fir needle oil; tea tree oil; turpentine oil; thyme oil; Tolu balsam; tonka bean absolute; tuberose absolute; vanilla extract; violet leaf absolute; verbena oil; vetiver oil; juniperberry oil; wine lees oil; wormwood oil; wintergreen oil; ylang-ylang oil; hyssop oil; civet absolute; cinnamon leaf oil; cinnamon bark oil; and fractions thereof or ingredients isolated therefrom;

individual fragrances from the group comprising hydrocarbons, such as for example 3-carene; alpha-pinene; beta-pinene; alp[ha-terpinene; gamma-terpinene; p-cymene; bisabolene; camphene; caryophyllene; cedrene; farnesene; longifolene; myrcene; ocimene; valencene; (E,Z)-1,3,5-undecatriene; styrene; diphenylmethane;

aliphatic alcohols, such as for example hexanol; octanol; 3-octanol; 2,6-dimethylheptanol; 2-methyl-2-heptanol, 2-methyl-2-octanol; (E)-2-hexenol; (E)- and (Z)-3-hexenol; 1-octen-3-ol; a mixture of 3,4,5,6,6-pentamethyl-3/4-hepten-2-ol and 3,5,6,6-tetramethyl-4-methylene-heptan-2-ol; (E,Z)-2,6-nonadienol; 3,7-dimethyl-7-methoxyoctan-2-ol; 9-decenol; 10-undecenol; 4-methyl-3-decen-5-ol;

aliphatic aldehydes and their acetals such as for example hexanal; heptanal; octanal; nonanal; decanal; undecanal; dodecanal; tridecanal; 2-methyloctanal; 2-methylnonanal; (E)-2-hexenal; (Z)-4-heptenal; 2,6-dimethyl-5-heptenal; 10-undecenal; (E)-4-decenal; 2-dodecenal; 2,6,10-dimethyl-5,9-undecadienal; heptanal-diethylacetal; 1,1-dimethoxy-2,2,5-trimethyl-4-hexene; citronellyl oxyace-aldehyde; 1-(1-methoxy-propoxy-(E/Z)-3-hexene;

aliphatic ketones and oximes thereof, such as for example 2-hepta-none; 2-octanone; octanone; 2-nonanone; 5-methyl-3-heptanone; 5-methyl-3-heptanone oxime; 2,4,4,7-tetramethyl-6-octen-3-one;

aliphatic sulfur-containing compounds, such as for example 3-methylthiohexanol; 3-methylthiohexyl acetate; 3-mercaptohexanol; 3-mercaptohexyl acetate; 3-mercaptohexyl butyrate; 3-acetylthiohexyl acetate; 1-menthene-8-thiol;

aliphatic nitriles, such as for example 2-nonenenitrile; 2-undecenenitrile; 2-tridecenenitrile; 3,12-tridecadienenitrile; 3,7-dimethyl-2,6-octadienenitrile; 3,7-dimethyl-6-octenenitrile;

aliphatic carboxylic acid esters, such as for example (E)- and (Z)-3-hexenylformate; ethyl acetoacetate; isoamyl acetate; hexyl acetate; 3,5,5-trimethylhexyl acetate; 3-methyl-2-butenyl acetate; (E)-2-hexenyl acetate; (E)- and (Z)-3-hexenyl acetate; octyl acetate; 3-octyl acetate; 1-octen-3-yl acetate; ethyl butyrate; butyl butyrate; isoamyl butyrate; hexylbutyrate; (E)- and (Z)-3-hexenyl isobutyrate; hexyl crotonate; ethylisovalerate; ethyl-2-methyl pentanoate; ethyl hexanoate; allyl hexanoate; ethyl heptanoate; allyl heptanoate; ethyl octanoate; ethyl-(E,Z)-2,4-decadienoate in particular in particular ethyl-2-trans-4-cis-decadienoate; methyl-2-octinate; methyl-2-noninate; allyl-2-isoamyl oxyacetate; methyl-3,7-dimethyl-2,6-octadienoate; 4-methyl-2-pentyl-crotonate;

acyclic terpene alcohols, such as, for example, citronellol; geraniol; nerol; linalool; lavandulol; nerolidol; farnesol; tetrahydrolinalool; tetrahydrogeraniol; 2,6-dimethyl-7-octen-2-ol; 2,6-dimethyloctan-2-ol; 2-methyl-6-methylene-7-octen-2-ol; 2,6-dimethyl-5,7-octadien-2-ol; 2,6-dimethyl-3,5-octadien-2-ol; 3,7-dimethyl-4,6-octadien-3-ol; 3,7-dimethyl-1,5,7-octatrien-3-ol 2,6-dimethyl-2,5,7-octatrien-1-ol; as well as formates, acetates, propionates, isobutyrates, butyrates, isovalerates, pentanoates, hexanoates, crotonates, tiglinates and 3-methyl-2-butenoates thereof;

acyclic terpene aldehydes and ketones, such as, for example, geranial; neral; citronellal; 7-hydroxy-3,7-dimethyloctanal; 7-methoxy-3,7-dimethyloctanal; 2,6,10-trimethyl-9-undecenal; geranylacetone; as well as the dimethyl- and diethylacetals of geranial, neral and 7-hydroxy-3,7-dimethyloctanal;

cyclic terpene alcohols, such as, for example, menthol; isopulegol; alpha-terpineol; terpinen-4-ol; menthan-8-ol; menthan-1-ol; menthan-7-ol; borneol; isoborneol; linalool oxide; nopol; cedrol; ambrinol; vetiverol; guaiol; and the formates, acetates, propionates, isobutyrates, butyrates, isovalerates, pentanoates, hexanoates, crotonates, tiglinates and 3-methyl-2-butenoates thereof;

cyclic terpene aldehydes and ketones, such as, for example, menthone; isomenthone; 8-mercaptomenthan-3-one; carvone; camphor; fenchone; alpha-ionone; beta-ionone; alpha-n-methylionone; beta-n-methylionone; alpha-isomethylionone; beta-isomethylionone; alpha-irone; alpha-damascone; beta-damascone; beta-damascenone; delta-damascone; gamma-damascone; 1-(2,4,4-trimethyl-2-cyclohexen-1-yl)-2-buten-1-one; 1,3,4,6,7,8a-hexahydro-1,1,5,5-tetramethyl-2H-2,4-a-methanonaphthalen-8(5H)-one; 2-methyl-4-(2,6,6-trimethly-1-cyclohexen-1-yl)-2-butenal; nootkatone; dihydronootkatone; 4,6,8-megastigmatrien-3-one; alpha-sinensal; beta-sinensal; acetylated cedarwood oil (cedryl methyl ketone);

cyclic alcohols, such as, for example, 4-tert.-butylcyclohexanol; 3,3,5-trimethylcyclohexanol; 3-isocamphylcyclohexanol; 2,6,9-trimethyl-Z2,Z5,E9-cyclododecatrien-1-ol; 2-isobutyl-4-methyltetrahydro-2H-pyran-4-ol;

cycloaliphatic alcohols, such as, for example, alpha,3,3-trimethylcyclo-hexylmethanol; 1-(4-isopropylcyclohexyl)ethanol; 2-methyl-4-(2,2,3-trimethyl-3-cyclopent-1-yl) butanol; 2-methyl-4-(2,2,3-trimethyl-3-cyclopent-1-yl)-2-buten-1-ol; 2-ethyl-4-(2,2,3-trimethyl-3-cyclopent-1-yl)-2-buten-1-ol; 3-methyl-5-(2,2,3-trimethyl-3-cyclopent-1-yl)-pentan-2-ol; 3-methyl-5-(2,2,3-trimethyl-3-cyclopent-1-yl)-4-penten-2-ol; 3,3-dimethyl-5-(2,2,3-trimethyl-3-cyclopent-1-yl)-4-penten-2-ol; 1-(2,2,6-trimethylcyclohexyl)pentan-3-ol; 1-(2,2,6-trimethylcyclohexyl) hexan-3-ol;

cyclic and cycloaliphatic ethers, such as, for example, cineole; cedryl methyl ether; cyclododecyl methyl ether; 1,1-dimethoxycyclododecane; (ethoxymethoxy)cyclododecane; alpha-cedrene epoxide; 3a,6,6,9a-tetramethyldodecahydronaphtho[2,1-b]furan; 3a-ethyl-6,6,9a-trimethyl-dodecahydronaphtho[2,1-b]furan; 1,5,9-trimethyl-13-oxabicyclo[10.1.0]-trideca-4,8-diene; rose oxide; 2-(2,4-dimethyl-3-cyclohexen-1-yl)-5-methyl-5-(1-methylpropyl)-1,3-dioxan;

cyclic and macrocyclic ketones, such as, for example, 4-tert.-butylcyclohexanone; 2,2,5-trimethyl-5-pentylcyclopentanone; 2-heptylcyclopentanone; 2-pentylcyclopentanone; 2-hydroxy-3-methyl-2-cyclopenten-1-one; 3-methyl-cis-2-penten-1-yl-2-cyclopenten-1-one; 3-methyl-2-pentyl-2-cyclopenten-1-one; 3-methyl-4-cyclopentadecenone; 3-methyl-5-cyclopentadecenone; 3-methylcyclopentadecanone; 4-(1-ethoxyvinyl)-3,3,5,5-tetramethylcyclo-hexanone; 4-tert.-pentylcyclohexanone; 5-cyclohexadecen-1-one; 6,7-dihydro-1,1,2,3,3-pentamethyl-4(5H)-indanone; 8-cyclohexadecen-1-one; 7-cyclohexadecen-1-one; (7/8)-cyclohexadecen-1-one; 9-cycloheptadecen-1-one; cyclopentadecanone; cyclohexadecanone;

cycloaliphatic aldehydes, such as, for example, 2,4-dimethyl-3-cyclohexene carbaldehyde; 2-methyl-4-(2,2,6-trimethyl-cyclohexen-1-yl)-2-butenal; 4-(4-hydroxy-4-methylpentyl)-3-cyclohexene carbaldehyde; 4-(4-methyl-3-penten-1-yl)-3-cyclohexene carbaldehyde;

cycloaliphatic ketones, such as, for example, 1-(3,3-dimethylcyclohexyl)-4-penten-1-one; 2,2-dimethyl-3-cyclohexen-1-yl)-1-propanone; 1-(5,5-dimethyl-1-cyclohexen-1-yl)-4-penten-1-one; 2,3,8,8-tetramethyl-1,2,3,4,5,6,7,8-octahydro-2-naphtalenyl methyl ketone; methyl-2,6,10-trimethyl-2,5,9-cyclododecatrienyl ketone; tert.-butyl-(2,4-dimethyl-3-cyclohexen-1-yl) ketone;

esters of cyclic alcohols, such as, for example, 2-tert.-butylcyclohexyl acetate; 4-tert.-butylcyclohexyl acetate; 2-tert.-pentylcyclo-hexyl acetate; 4-tert.-pentylcyclohexyl acetate; decahydro-2-naphthyl acetate; 2-cyclopentylcyclopentyl crotonate; 3-pentyltetrahydro-2H-pyran-4-yl acetate; decahydro-2,5,5,8a-tetramethyl-2-naphthyl acetate; 4,7-methano-3a,4,5,6,7,7a-hexahydro-5 or 6-indenyl acetate; 4,7-methano-3a,4,5,6,7,7a-hexahydro-5 or 6-indenyl propionate; 4,7-methano-3a,4,5,6,7,7a-hexahydro-5 or 6-indenyl-isobutyrate; 4,7-methanooctahydro-5 or 6-indenyl acetate;

esters of cycloaliphatic alcohols, such as, for example, 1-cyclohexyl ethyl crotonate;

esters of cycloaliphatic carboxylic acids, such as, for example, allyl 3-cyclohexyl-propionate; allyl cyclohexyl oxyacetate; cis- and trans-methyl dihydrojasmonate; cis- and trans-methyl jasmonate; methyl jasmonate; methyl-2-hexyl-3-oxycyclopentanecarboxylate; ethyl 2-ethyl-6,6-dimethyl-2-cyclohexenecarboxylate; ethyl 2,3,6,6-tetramethyl-2-cyclohexenecarboxylate; ethyl 2-methyl-1,3-dioxolane-2-acetate;

araliphatic alcohols, such as, for example, benzyl alcohol; 1-phenylethyl alcohol; 2-phenylethyl alcohol; 3-phenylpropanol; 2-phenylpropanol; 2-phenoxyethanol; 2,2-dimethyl-3-phenylpropanol; 2,2-dimethyl-3-(3-methylphenyl) propanol; 1,1-dimethyl-2-phenylethyl alcohol; 1,1-dimethyl-3-phenylpropanol; 1-ethyl-1-methyl-3-phenylpropanol; 2-methyl-5-phenylpentanol; 3-methyl-5-phenylpentanol; 3-phenyl-2-propen-1-01; 4-methoxybenzyl alcohol; 1-(4-isopropylphenyl)ethanol;

esters of araliphatic alcohols and aliphatic carboxylic acids, such as, for example, benzyl acetate; benzyl propionate; benzyl isobutyrate; benzyl isovalerate; 2-phenylethyl acetate; 2-phenylethyl propionate; 2-phenylethyl isobutyrate; 2-phenylethyl isovalerate; 1-phenylethyl acetate; alpha-trichloromethylbenzyl acetate; alpha,alpha-dimethylphenylethyl acetate; alpha,alpha-dimethylphenylethyl butyrate; cinnamyl acetate; 2-phenoxyethyl isobutyrate; 4-methoxybenzyl acetate;

araliphatic ethers, such as for example 2-phenylethyl methyl ether; 2-phenylethyl isoamyl ether; 2-phenylethyl-1-ethoxyethyl ether; phenylacetaldehyde dimethyl acetal; phenylacetaldehyde diethyl acetal; hydratropaaldehyde dimethyl acetal; phenylacetaldehyde glycerol acetal; 2,4,6-trimethyl-4-phenyl-1,3-dioxane; 4,4a,5,9b-tetrahydroindeno[1,2-d]-m-dioxin; 4,4a,5,9b-tetrahydro-2,4-dimethylindeno[1,2-d]-m-dioxin;

aromatic and araliphatic aldehydes, such as, for example, benzaldehyde; phenylacetaldehyde; 3-phenylpropanal; hydratropaldehyde; 4-methylbenzaldehyde; 4-methylphenylacetaldehyde; 3-(4-ethylphenyl)-2,2-dimethylpropanal; 2-methyl-3-(4-isopropylphenyl)propanal; 2-methyl-3-(4-tert.-butylphenyl)propanal; 3-(4-tert.-butylphenyl)propanal; cinnamaldehyde; alpha-butylcinnamaldehyde; alpha-amylcinnamaldehyde; alpha-hexylcinnamaldehyde; 3-methyl-5-phenylpentanal; 4-methoxybenz-aldehyde; 4-hydroxy-3-methoxybenzaldehyde; 4-hydroxy-3-ethoxybenzaldehyde; 3,4-methylenedioxybenzaldehyde; 3,4-dimethoxybenzaldehyde; 2-methyl-3-(4-methoxyphenyl)propanal; 2-methyl-3-(4-methylendioxyphenyl)propanal;

aromatic and araliphatic ketones, such as, for example, acetophenone; 4-methylacetophenone; 4-methoxyacetophenone; 4-tert.-butyl-2,6-dimethylacetophenone; 4-phenyl-2-butanone; 4-(4-hydroxyphenyl)-2-butanone; 1-(2-naphthalenyl)ethanone; 2-benzofuranylethanone; (3-methyl-2-benzylfuranyl)ethanone; benzophenone; 1,1,2,3,3,6-hexamethyl-5-indanyl methyl ketone; 6-tert.-butyl-1,1-dimethyl-4-indanyl methyl ketone; 1-[2,3-dihydro-1,1,2,6-tetramethyl-3-(1-methyl-ethyl)-1H-5-indenyl]ethanone; 5',6',7',8'-tetrahydro-3',5',5',6',8',8'-hexa-methyl-2-acetonaphthone;

aromatic and araliphatic carboxylic acids and esters thereof, such as, for example, benzoic acid; phenylacetic acid; methyl benzoate; ethyl benzoate; hexyl benzoate; benzyl benzoate; methyl phenylacetate; ethyl phenylacetate; geranyl phenylacetate; phenylethyl phenylacetate; methyl cinnamate; ethyl cinnamate; benzyl cinnamate; phenylethyl cinnamate; cinnamyl cinnamate; allyl phenoxyacetate; methyl salicylate; isoamyl salicylate; hexyl salicylate; cyclohexyl salicylate; cis-3-hexenyl salicylate; benzyl salicylate; phenylethyl salicylate; methyl 2,4-dihydroxy-3,6-dimethylbenzoate; ethyl 3-phenylglycidate; ethyl 3-methyl-3-phenylglycidate;

nitrogen-containing aromatic compounds, such as, for example, 2,4,6-trinitro-1,3-dimethyl-5-tert.-butylbenzene; 3,5-dinitro-2,6-dimethyl-4-tert.-butylacetophenone; cinnamonitrile; 5-phenyl-3-methyl-2-pentenonitrile; 5-phenyl-3-methylpentanonitrile; methyl anthranilate; methy-N-methylanthranilate; Schiffs bases of methyl anthranilate with 7-hydroxy-3,7-dimethyloctanal, 2-methyl-3-(4-tert.-butylphenyl)propanal or 2,4-dimethyl-3-cyclohexene carbaldehyde; 6-isopropylquinoline; 6-isobutylquinoline; 6-sec.-butylquinoline; indole; skatole; 2-methoxy-3-isopropylpyrazine; 2-isobutyl-3-methoxypyrazine;

phenols, phenyl ethers and phenyl esters, such as, for example, estragole; anethole; eugenol; eugenyl methyl ether; isoeugenol; isoeugenol methyl ether; thymol; carvacrol; diphenyl ether; beta-naphthyl methyl ether; beta-naphthyl ethyl ether; beta-naphthyl isobutyl ether; 1,4-dimethoxybenzene; eugenyl acetate; 2-methoxy-4-methylphenol; 2-ethoxy-5-(1-propenyl)phenol; p-cresyl phenylacetate; heterocyclic compounds, such as, for example, 2,5-dimethyl-4-hydroxy-2H-furan-3-one; 2-ethyl-4-hydroxy-5-methyl-2H-furan-3-one; 3-hydroxy-2-methyl-4H-pyran-4-one; 2-ethyl-3-hydroxy-4H-pyran-4-one;

lactones, such as, for example, 1,4-octanolide; 3-methyl-1,4-octanolide; 1,4-nonanolide; 1,4-decanolide; 8-decen-1,4-olide; 1,4-undecanolide; 1,4-dodecanolide; 1,5-decanolide; 1,5-dodecanolide; 4-methyl-1,4-decanolide; 1,15-pentadecanolide; cis- and trans-11-pentadecen-1,15-olide; cis- and trans-2-pentadecen-1,15-olide; 1,16-hexadecanolide; 9-hexadecen-1,16-slide; 10-oxa-1,16-hexadecanolide; 11-oxa-1,16-hexadecanolide; 12-oxa-1,16-hexadecanolide; ethylene-1,12-dodecanedioate; ethylene-1,13-tridecanedioate; coumarin; 2,3-dihydrocoumarin; octahydrocoumarin As already mentioned, compounds of formula (I), in particular hex-5-enyl-2-methyl butyrate or mixtures of hex-5-enyl-2-methyl butyrate and one or more further compounds of formula (I), because of their olfactory characteristics, are particularly well-suited for use in fragrance substance preparations. One or more compounds of formula (I) can also be used in corresponding fragrance substance preparations in combination with a further individual fragrance substance or a number of further fragrance substances can be used in combination. Of particular advantage is the combination of the compound with other fragrance substances, preferably selected from the fragrance substances already mentioned above or those mentioned in the following, in differing quantity ratios, to form novel fragrance substance or perfume preparations.

Compounds of formula (I) or fragrance substance preparations according to the invention are preferably used for the manufacture of perfumed articles. The sensorial characteristics like the material characteristics (such as solubility in the usual solvents and compatibility with the usual other components of such products) as well as the toxicological harmlessness of the compounds of formula (I) to be used according to the invention underline their particular suitability for the stated purposes. The further positive characteristics described below in connection with further applications according to the invention contribute to the compounds of formula (I) or fragrance substance preparations according to the invention being particularly preferred in detergents, hygiene or grooming products, in particular in the area of personal hygiene and hair care, cosmetics and the home.

Consequently, in connection with the present invention a perfumed article is indicated which contains one or more compounds of formula (I) or a fragrance substance preparation according to the invention as defined above. With regard to preferred embodiments the above statements apply by analogy. Preferred articles according to the invention are selected from the group comprising:

perfume extracts, eau de parfums, eau de toilettes, aftershaves, eau de colognes, pre-shave products, splash colognes, perfumed freshening wipes, perfumes for acid, alkaline and neutral cleaning agents, detergents, washing tablets, disinfectants, as well as air fresheners, aerosol sprays, waxes and polishes, and personal hygiene agents, bath oils, cosmetic emulsions, such as for example skin creams and lotions, sun protection creams and lotions, after-sun creams and lotions, hand creams and lotions, foot creams and lotions, depilatory creams and lotions, after-shave creams and lotions, bronzing creams and lotions, hair care products such as, for example, hair sprays, hair gels, hair lotions, hair rinses, hair dyes, hair shaping and hair smoothing agents, hair tonics, hair creams and lotions, deodorants and anti-perspirants, decorative cosmetic products such as, for example, eye shadow, nail varnish, make-ups, lipsticks, mascara and candles, lamp oils, incense sticks, insecticides, repellents, propellants.

Compounds of formula (I) and fragrance substance preparations according to the invention containing one or more compounds of formula (I), in particular hex-5-enyl-2-methyl butyrate or mixtures of hex-5-enyl-2-methyl butyrate and one or more further compounds of formula (I), can generally (for example in concentrated form, in solutions or in the modified form described below) be used for the manufacture of, for example, perfume extracts, eau de parfums, eau de toilettes, aftershaves, eau de colognes, pre-shave products, splash colognes and perfumed freshening wipes and for perfuming acid, alkaline and neutral cleaning agents, such as, for example, floor cleaners, window cleaners, washing-up liquids, bath and sanitary equipment cleaners, scouring agents, solid and liquid WC cleaners, carpet cleaners in powder and foam form, liquid detergents, powder detergents, laundry pretreatment agents, such as bleaching agents, softeners and stain removers, fabric conditioners, laundry soaps, laundry tablets, disinfectants, surface disinfectants and air fresheners in liquid or gel form or applied to a solid support, aerosol sprays, waxes and polishes, such as furniture polishes, floor waxes, cream shoe polishes and personal hygiene agents, such as, for example, solid and liquid soaps, shower gels, shampoos, shaving soaps, shaving foams, bath oils, cosmetic emulsions of the oil-in-water, of the water-in-oil and of the water-in-oil-in-water type, such as, for example, skin creams and lotions, face creams and lotions, sun protection creams and lotions, after-sun creams and lotions, hand creams and lotions, foot creams and lotions, depilatory creams and lotions, after-shave creams and lotions, bronzing creams and lotions, hair care products, such as, for example, hair sprays, hair gels, hair lotions, hair rinses, permanent and semi-permanent hair dyes, hair shaping agents such as cold permanent waves, and hair smoothing agents, hair tonics, hair creams and lotions, deodorants and antiperspirants, such as, for example, under-arm sprays, roll-ons, deodorant sticks, deodorant creams, decorative cosmetic products such as, for example, eye shadow, nail varnish, make-ups, lipsticks, mascara as well as candles, lamp oils, incense sticks, insecticides, repellents, propellants.

For the compounds of formula (I) or fragrance substance preparations and their preferred embodiments contained in the perfumed articles according to the invention that stated in the above applies by analogy. The fragrance substance preparations according to the invention or the fragrance substance preparations, mentioned above, to be used according to the invention in the corresponding articles, can be used for perfuming in liquid form, undiluted or diluted with a solvent. Suitable solvents for this are, for example, ethanol, isopropanol, diethylene glycol monoethyl ether, glycerine, propylene glycol, 1,2-butylene glycol, dipropylene glycol, diethyl phthalate, triethyl citrate, isopropyl myristate, and so on. For the stated solvents, it is the case that in connection with the present text where these have their own olfactory characteristics they will solely be assigned to the "solvent" component and not the "fragrance substances".

The compounds of formula (I) or fragrance substance preparations contained in the perfumed articles according to the invention can also be absorbed in a preferred embodiment, in a carrier, which ensures both a subtle distribution of the fragrance substances in the product and a controlled release during the application. Such carriers can be porous inorganic materials such as light sulfate, silica gels, zeolites, gypsums, clays, clay granules, aerated concrete and so on, or organic materials such as woods and cellulose-based materials.

The compounds of formula (I) to be used according to the invention or fragrance substance preparations according to the invention can also be in micro-encapsulated or spray-dried, inclusion complex or extrusion products form and added in this form to the product or article to be perfumed.

Optionally the characteristics of the fragrance substance preparations modified in this way can be further optimized by so-called coatings with suitable materials to provide a more targeted release of the scent, for which purpose preferably waxy synthetic substances such as, for example polyvinyl alcohol are used.

The micro-encapsulation of the fragrance substance preparations can, for example, take place using the so-called coacervation method with the help of capsule materials such as polyurethane-like substances or soft gelatine. Spray-dried perfume oils, for example, can be produced by spray drying of an emulsion or dispersion containing the perfume oil, wherein as the carrier material modified starches, proteins, dextrin and vegetable gums can be used. Inclusion complexes, for example, can be manufactured by including dispersions of the fragrance substance preparation and cyclodextrins or urea derivatives in a suitable solvent, such as water. Extrusion products can be created by melting the fragrance substance preparation with a suitable wax-like material and by extrusion with subsequent solidification, optionally in a suitable solvent such as isopropanol.

Therefore the fragrance substance preparations according to the invention, as already mentioned, can be used in the modified form mentioned above for the production of the corresponding perfumed articles according to the invention.

Ingredients with which the compounds of formula (I) to be used according to the invention, in particular hex-5-enyl-2-methyl butyrate, can preferably be combined are, for example: preservatives, abrasives, antiacne agents, agents against ageing of the skin, antibacterial agents, anti-cellulitis agents, antidandruff agents, antiinflammatory agents, irritation-preventing agents, irritation-inhibiting agents, antimicrobial agents, antioxidants, astringents, perspiration-inhibiting agents, antiseptic agents, antistatics, binders, buffers, carrier materials, chelating agents, cell stimulants, cleansing agents, care agents, depilatory agents, surface-active substances, deodorizing agents, antiperspirants, softeners, emulsifiers, enzymes, essential oils, fibres, film-forming agents, fixatives, foam-forming agents, foam stabilizers, substances for preventing foaming, foam boosters, fungicides, gelling agents, gel-forming agents, hair care agents, hair setting agents, hair straightening agents, moisture-donating agents, moisturizing substances, moisture-retaining substances, bleaching agents, strengthening agents, stain-removing agents, optically brightening agents, impregnating agents, dirt-repellent agents, friction-reducing agents, lubricants, moisturizing creams, ointments, opacifying agents, plasticizing agents, covering agents, polish, gloss agents, polythers, powders, proteins, re-oiling agents, abrading agents, silicones, skin soothing agents, skin cleansing agents, skin care agents, skin healing agents, skin lightening agents, skin protecting agents, skin softening agents, cooling agents, skin cooling agents, warming agents, skin warming agents, stabilizers, UV-absorbing agents, UV filters, detergents, fabric conditioners, suspending agents, skin tanning agents, thickeners, vitamins, oils, waxes, fats, phospholipids, saturated fatty acids, mono- or polyunsaturated fatty acids, hydroxy acids, polyhydroxy-fatty acids, liquefiers, dyestuffs, color-protecting agents, pigments, anticorrosives, aromas, flavoring substances, odoriferous substances, polyols, surfactants, electrolytes, organic solvents or silicone derivatives.

In the following further descriptions are provided of uses according to the invention of compounds of formula (I), in particular hex-5-enyl-2-methyl butyrate, or mixtures containing compounds of formula (I), in particular hex-5-enyl-2-methyl butyrate.

For products containing a surface acting agent the substantivity of the fragrance substances or fragrance substance preparations with regard to their retention on the substrate, in particular hair or textile fibres, is another important application requirement of the perfume mixture. Surprisingly it turns out that compounds of formula (I), and at the same time especially hex-5-enyl-2-methyl butyrate are particularly, especially for a fruity fragrance substance, characterized by a high attachment capacity (inherent bonding to a substrate) and a high substantivity (ability to attach from a usually aqueous, phase to a substrate or also to remain on a substrate following a washing or rinsing process). This effect is explained in more detail below in connection with the shampoo example.

Thus a further aspect of the present invention concerns the use of compounds of formula (I), preferably hex-5-enyl-2-methyl butyrate, as a means to increase the substantivity and/or retention of a fragrance substance preparation.

The compounds of formula (I) to be used according to the invention, especially hex-5-enyl-2-methyl butyrate, are therefore particularly well-suited to use in products containing a surface active agent.

The product is preferably one of the following:

- an acid, alkaline or neutral cleaning agent, in particular selected from the group comprising all-purpose cleaners, floor cleaners, window cleaners, washing up liquids, bath and sanitary equipment cleaners, scouring agents, solid and liquid WC cleaners, carpet cleaners in powder and foam form, liquid detergents, powder detergents, laundry pre-treatment agents, such as bleaching agents, softeners and stain removers, fabric conditioners, laundry soaps, laundry tablets, disinfectants, surface disinfectants,
- an air freshener in liquid or gel form or applied to a solid support or as an aerosol spray,
- a wax or polish, in particular selected from the group comprising furniture polishes, floor waxes and cream shoe polishes, or a personal hygiene agent which is in particular selected from the group comprising shower gels and shampoos.

A further facet of the present invention concerns the use of compounds of formula (I), preferably hex-5-enyl-2-methyl butyrate as a means of increasing the complex stability of a fragrance substance preparation.

Fragrance mixtures are often sought which have a fruity and green head note, with these also having to have a distinctive blooming (smell from an aqueous solution). As will be demonstrated in connection with the embodiments further below, the compounds of formula (I) to be used according to the invention, in particular hex-5-enyl-2-methyl butyrate, are also suited to this purpose.

Accordingly, a further facet of the present invention concerns the use of compounds of formula (I), in particular hex-5-enyl-2-methyl butyrate as a means of increasing the smell of other fragrance substances noticed over a surface active agent containing aqueous solution.

The fragrance compounds of formula (I) to be used according to the invention, in particular hex-5-enyl-2-methyl butyrate, also demonstrate a good spatial effect/diffusiveness, such that the compounds of formula (I) are particularly suited to inclusion in the following types of products:

- air fresheners, preferably in liquid or gel form, or as a spray;

sprays (e.g. pump sprays or aerosol sprays), such as, for example, spray cleaners, hair sprays or sun protection sprays;

deodorants and antiperspirants (under-arm sprays, roll-ons, deodorant sticks), with particular preference here for deodorants and antiperspirants in spray form.

It also transpires that the compounds of formula (I) to be used according to the invention, in particular hex-5-enyl-2-methyl butyrate, cover up the smell of ammonia very well, that is to say that the compounds of formula (1) mask or even to some extent (largely) neutralize the unpleasant smell of ammonia. Because of this smell-masking property, which is in addition to the fragrance substance property described above, in particular in respect of the smell of ammonia, the compounds of formula (I) are particularly well suited to inclusion in oxidation hair dyes, e.g. semi-permanent or permanent hair dyes, which contain ammonia or release ammonia. Such hair dyes usually contain two components:

first a hair dye base, containing one or more couplers. The hair dye base contains ammonia or releases ammonia, so that the pH is usually in the range 9-13, generally in the range 10-11.5;

and secondly a developer (oxidation component), which normally contains hydrogen peroxide ($H_2O_2$), the pH of which is usually in the range 2-4.5, and regularly in the range 2.5-4.

The compound of formula (I) to be used according to the invention, preferably hex-5-enyl-2-methyl butyrate, is preferably a component of the hair dye base, which usually contains ammonia (as $NH_3$ or in the form of $NH_4OH$) or can release ammonia, for example from ammonium carbonate.

In summary, therefore, the present invention also concerns the use of a compound of formula (I), as defined above, preferably hex-5-enyl-2-methyl butyrate, to cover up, i.e. to mask and/or neutralize, the smell of ammonia.

Accordingly the invention also concerns mixtures containing (i) ammonia or a substance that release ammonia and (ii) one or more compounds of formula (I), preferably at least hex-5-enyl-2-methyl butyrate.

The compounds of formula (I) to be used according to the invention as fragrance substances, in particular hex-5-enyl-2-methyl butyrate, can in each case be manufactured by esterification as described in the current standard reference works of preparatory chemistry.

In a preferred manufacturing method 2-methyl-butyric acid and 5-hexenol in are heated in equimolar quantities under acid catalysis in the water separator. This reaction can be illustrated, by way of example, using the following diagram:

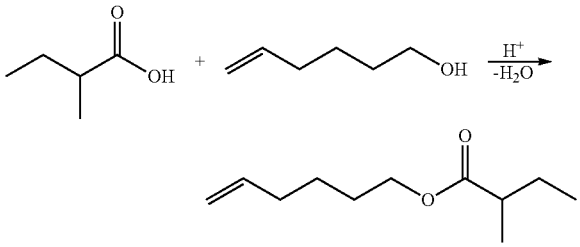

A fragrance substance preparation according to the invention is manufactured according to the invention by mixing one or more compounds of formula (I), preferably hex-5-enyl-2-methyl butyrate or a mixture of hex-5-enyl-2-methyl butyrate with one or more further compounds of formula (I), with the further fragrance substance(s) and optionally further components of the fragrance substance preparation.

According to a preferred embodiment the fragrance substance preparation according to the invention is manufactured as described above, but with one or more compounds of formula (I), preferably hex-5-enyl-2-methyl butyrate or a mixture of hex-5-enyl-2-methyl butyrate with one or more further compounds of formula (I), being used in a quantity which, in the fragrance substance preparation, is sufficient to convey, modify and/or intensify one or preferably both of the fragrance notes fruity and green.

For the components to be preferably selected in addition to the hex-5-enyl-2-methyl butyrate, that stated above applies by analogy.

As already mentioned, compounds of formula (I), preferably hex-5-enyl-2-methyl butyrate, according to the invention can be used as a means to provide hair or textile fibres with one or preferably both the fragrance notes fruity and green.

Accordingly, a further facet of the present invention concerns the provision of (a) hairs or (b) textile fibres with one or preferably both the fragrance notes fruity and green, consisting of the following steps:

i) preparation of a mixture comprising one or more compounds of formula (I), or of a fragrance substance preparation according to the invention as defined above, ii) application of the mixture or the fragrance substance composition to (a) the hair or (b) the textile fibres.

The invention is explained in more detail in the following with the use of examples.

Unless otherwise stated, all data, in particular quantities and percentages, refer to the weight.

The following abbreviations are used: BA=benzyl alcohol, DPG=dipropylene glycol, IPM=isopropylmyristate, TEC=triethyl citrate

EXAMPLE 1

Preparation of hex-5-enyl-2-methyl butyrate 573 g (5.73 mol) 5-hexen-1-ol, 584 g (5.73 mol) 2-methyl butyric acid, 8 g para-toluolsulfonic acid and 1200 ml cyclohexane are presented and heated for 4 hours on the water separator with recycling. 82 ml water are separated. Washing then takes place, first with saturated sodium hydrogen carbonate solution and then with water. The organic phase is dried over sodium sulfate and the solvent extracted on the rotary evaporator. The residue (1,200 g) is distilled in a vacuum of 0.8 mbar in a 30 cm long glass tower column. At a boiling point of 76'C, 777 g of hex-5-enyl-2-methyl butyrate are then obtained. This corresponds to a yield of 74%. Spectroscopic and spectrometric data of hex-5-enyl-2-methyl butyrate:

$^1$H-NMR ($CDCl_3$, 400 MHz, TMS=0 ppm): δ=0.91 ppm (t, —$CH_3$, 3H), 1.14 (d, —$CH_3$, 3H), 1.42-1.73 (m, 3 —$CH_2$, 6H), 2.09 (m, —$CH_2$, 2H), 2.36 (m, —CH, 1H), 4.08 (t, —$CH_2$, 2H), 4.96 (d,d,t, =$CH_2$, 1H), 5.02 (d,d,t, =$CH_2$, 1H), 5.80 (d,d,t, =CH, 1H).

MS (m/e, %): 184 ($M^+$, 1), 103 (20), 85 (50), 67 (65), 57 (100), 54 (63), 41 (52), 29 (27).

IR (Film): v=1150 $cm^{-1}$ (C—O), 1175, 1520 (C=O), 2860, 2920, 2950, 3080.

EXAMPLE 2

Fragrance Substance Preparation with and without hex-5-enyl-2-methyl butyrate

| | Perfume oil AE | Perfume oil AB |
|---|---|---|
| Agrumex ® HC | 20.00 | 20.00 |
| Aldehyde C10 | 3.00 | 3.00 |
| Aldehyde C14 so-called | 80.00 | 80.00 |
| Bay oil, 10% in DPG | 3.00 | 3.00 |
| Benzaldehyde, 10% in DPG | 2.00 | 2.00 |
| Benzyl acetate | 30.00 | 30.00 |
| Buchu leaf oil coeur, 10% in ethanol | 1.00 | 1.00 |
| Claritone ® [1] | 15.00 | 15.00 |
| Corps 1490, 0.1% in DPG | 50.00 | 50.00 |
| Cumin oil, 10% in DPG | 1.00 | 1.00 |
| Alpha-damascone, 10% in DPG | 2.00 | 2.00 |
| Delta-decalactone, 10% in DPG | 8.00 | 8.00 |
| Gamma-decalactone | 4.00 | 4.00 |
| Diethyl malonate | 15.00 | 15.00 |
| Dimethylbenzyl carbinyl butyrate | 10.00 | 10.00 |
| Filbertone, 0.01% in DPG | 5.00 | 5.00 |
| Floropal ® | 7.00 | 7.00 |
| Frambinon ® | 2.00 | 2.00 |
| Globalide ® | 4.00 | 4.00 |
| Hexenol-trans-2, 10% in DPG | 10.00 | 10.00 |
| Hexenyl acetate cis, trans-3, 10% in DPG | 10.00 | 10.00 |
| Hexenyl isobutyrate cis-3, 10% in DPG | 1.00 | 1.00 |
| Hexyl benzoate | 1.00 | 1.00 |
| Hexyl butyrate | 1.00 | 1.00 |
| Isobutyl salicylate | 36.00 | 36.00 |
| Jasmopyrane | 12.00 | 12.00 |
| Linalool | 25.00 | 25.00 |
| *Litsea cubeba* oil | 10.00 | 10.00 |
| Maltol, 5% in BA | 6.00 | 6.00 |
| L-menthyl acetate | 3.00 | 3.00 |
| Methyloctin carbonate 10% in DPG | 1.00 | 1.00 |
| Gamma-octalactone, 10% in DPG | 5.00 | 5.00 |
| Brazilian orange oil | 25.00 | 25.00 |
| Oxania Base | 4.50 | 4.50 |
| Prenyl acetate, 10% in DPG | 2.00 | 2.00 |
| Projasmone P | 5.00 | 5.00 |
| Rosaphen ® | 20.00 | 20.00 |
| Thiomenthanone-3,8, 1% in TEC | 3.00 | 3.00 |
| Undecavertol | 1.50 | 1.50 |
| Vertocitral, 10% in DPG | 24.00 | 24.00 |
| Hex-5-enyl-2-methyl butyrate | 10.00 | — |
| DPG (dipropylene glycol) | 512.00 | 522.00 |
| | 1,000 | 1,000 |

[1] Trade name of Symrise, Holzminden, D
[2] Trade name of IFF, New Jersey, US
[3] Trade name of Firmenich, Geneva, CH
[4] Trade name of Givaudan, Zurich, CH In the demonstration examples of perfume oils AE/AB it is a case of fragrance substance preparations, especially perfumistic preparations of the fruity type (exotic fruit), comprising natural, synthetic naturally-identical and fully synthetic fragrance substances.

The two perfume oils are incorporated in an EDT, shampoo and an air freshener in gel form.

The formulations for the abovementioned matrices are as follows:

EDT (Eau-de-Toilette):

| | |
|---|---|
| Ethanol | 96% |
| Perfume oil | 4% |

Shampoo:

| | |
|---|---|
| Sodium lauryl ether sulfate (e.g. Texapon NSO, from Cognis Deutschland GmbH) | 20% |
| Sodium chloride | 1.4% |
| Citric acid | 1.3% |
| Phenoxyethanol, methyl-, ethyl-, butyl- and propylparaben | 0.5% |
| Water | 76.3% |
| Perfume oil | 0.5% |

The pH of the shampoo is approximately 6. From this 100 ml of a 20% by weight aqueous shampoo solution are produced. This shampoo solution is used to wash strands of hair for 2 minutes which are then rinsed for 20 seconds under running lukewarm water. Both strands of hair are assessed for smell when dry.

Air Freshener in Gel Form

| Component | Explanation | % by weight |
|---|---|---|
| Demineralized water | | To 100 |
| Genugel ® X-6424 | Carrageenan | 2.00 |
| Perfume oil | | 0.60 |
| Arkopal ® N 100 or Tergitol ® NP 10 | Emulsifier | 3.50 |
| Preventol ® D 7 | Preservative | 5.00 |

EXAMPLE 3

Deodorant Products Containing Perfume Oil According to the Invention

| | Perfume oil MF | Perfume oil MD |
|---|---|---|
| Bay oil | 1.00 | 1.00 |
| Lavandin oil abrialis | 10.00 | 10.00 |
| Dihydromyrcenol | 100.00 | 100.00 |
| Florosa | 10.00 | 10.00 |
| Ligustral ® | 4.00 | 4.00 |
| Amber core (1-[[2-(1,1-dimethylethyl)cyclohexyl]oxy]-2-butanol) | 15.00 | 15.00 |
| Vertofix ® | 60.00 | 60.00 |
| *Eucalyptus* oil, natural | 2.50 | 2.50 |
| Hedione ® (methyl dihydrojasmonate) | 120.00 | 120.00 |
| cis-3-hexenol | 2.00 | 2.00 |
| Evernyl ® (methyl-2,4-dihydroxy-3,6-dimethyl benzoate) | 6.00 | 6.00 |
| Isoraldeine ® 70 (contains mainly alpha-isomethylionone and alpha-n-methylionone) | 10.00 | 10.00 |
| Allyl amyl glycolate | 4.00 | 4.00 |
| Iso E Super ® | 120.00 | 120.00 |
| Calone ® 1951 | 1.00 | 1.00 |
| Galaxolide ®, 50% in IPM | 80.00 | 80.00 |
| Melonal ® | 0.50 | 0.50 |
| Bergamot oil | 80.00 | 80.00 |
| Cardamom oil | 3.00 | 3.00 |
| Ethyl acetoacetate | 6.00 | 6.00 |
| Armoise oil | 2.00 | 2.00 |
| Estragon oil | 4.00 | 4.00 |
| Floralozone ® | 0.50 | 0.50 |
| Mandarin aldehyde, 10% in TEC | 1.50 | 1.50 |
| Isobutylquinoline, 10% in DPG | 4.00 | 4.00 |
| Gamma-decalactone, 10% in DPG | 1.00 | 1.00 |
| Aldehyde C10, 10% in DPG | 3.00 | 3.00 |
| Alpha-damascone, 10% in IPM | 3.00 | 3.00 |
| 2-methyl undecanal, 10% in DPG | 2.00 | 2.00 |

-continued

| | Perfume oil MF | Perfume oil MD |
|---|---|---|
| Stemone ®, 10% in DPG | 3.00 | 3.00 |
| Damascenone, 10% in DPG | 4.00 | 4.00 |
| Sandranol ® | 25.00 | 25.00 |
| Aurelione ® (mixture of 7-cyclohexadecanone and 8-cyclohexadecanone) | 4.50 | 4.50 |
| Vertoprenal ® | 0.50 | 0.50 |
| Ambral ® | 3.00 | 3.00 |
| Ambroxide ®, crystalline | 3.00 | 3.00 |
| Limonenal | 2.00 | 2.00 |
| Hexyl acetate | 6.00 | 6.00 |
| Isomenthone | 0.50 | 0.50 |
| Agrumex ® HC | 12.00 | 12.00 |
| Cis-3-hexenyl acetate | 4.00 | 4.00 |
| Patchouli oil | 10.00 | 10.00 |
| Isopropyl myristate | 146.50 | 166.50 |
| Hex-5-enyl-2-methyl butyrate | 20.00 | — |
| TOTAL: | 900 | 900 |

EXAMPLE 3.1

Deodorant Sticks

| Component | A % by weight | B % by weight |
|---|---|---|
| Sodium stearate | 8.00 | 8.00 |
| PPG-3 myristyl ether | 70.00 | 70.00 |
| 1,2-propylene glycol | 10.00 | 10.00 |
| 1,1-dimethyl-3-phenyl propanol | 0.20 | 0.25 |
| 2-butyloctanoic acid | — | 0.20 |
| Perfume oil AE from example 2 | 0.50 | — |
| Perfume oil MF from example 3 | — | 0.65 |
| Water | To 100 | To 100 |

EXAMPLE 3.2

Microemulsion Gels

| Component | % by weight | % by weight |
|---|---|---|
| Glycerine isostearate | 1.80 | 2.00 |
| Octoxyglycerine | 1.00 | 0.80 |
| Ceteareth-15 | 5.20 | 5.00 |
| PEG-150 distearate | 1.00 | 1.00 |
| Aluminum hydrochloride | 5.00 | 5.00 |
| Isotridecylisononanoate | 3.30 | 3.50 |
| Cyclomethicone | 6.60 | 6.40 |
| Perfume oil MF from example 3 | 0.55 | 0.70 |
| Water | To 100 | To 100 |

EXAMPLE 3.3

Antiperspirants

| Component | % by weight | % by weight |
|---|---|---|
| Reach AZP-908 SUF | 24.00 | 22.00 |
| Cyclomethicone (Pentamer) | To 100 | To 100 |
| Polydecene (Silkflo 364 NF) | 17.50 | 20.00 |
| Neo Helipan OS (ethylhexyl salicylate, Symrise) | 2.50 | 1.00 |
| L-menthyllactate (Frescolat ML, Symrise) | 0.25 | — |
| Polyethylene | 3.00 | 3.00 |
| Hydrogenated castor oil | 2.00 | 2.00 |
| Promyristyl PM-3 | 7.00 | 7.00 |
| PEG-8 distearate | 3.00 | 3.00 |
| Silicon dioxide (Cab-O-Sil M-5) | 1.00 | 1.00 |
| Stearyl alcohol | 15.00 | 10.00 |
| Octyldodecanol | — | 8.00 |
| Perfume oil AE from example 2 | 0.80 | — |
| Perfume oil MF from example 3 | — | 0.95 |

EXAMPLE 3.4

Suspension Sticks

| Component | % by weight | % by weight |
|---|---|---|
| Stearyl alcohol | 20.00 | 20.00 |
| Cyclomethicone | To 100 | To 100 |
| PPG-14 butyl ether | 2.00 | 2.00 |
| Hydrogenated castor oil | 1.00 | 1.00 |
| Talc | 2.00 | 2.00 |
| Aluminum hydrochloride, powder | 20.00 | 20.00 |
| Triclosan ® (5-chloro-2-(2,4-dichlorophenoxy)phenol) | 0.30 | — |
| Ethylhexylglycerine (octoxyglycerine) | 0.50 | 0.80 |
| 1,1-dimethyl-3-phenyl propanol | 0.30 | 0.40 |
| Aniseed alcohol | 0.10 | — |
| Perfume oil AE from example 2 | 0.70 | — |
| Perfume oil MF from example 3 | — | 0.85 |

EXAMPLE 3.5

Deodorant Spray

| Component | % by weight | % by weight |
|---|---|---|
| PEG-40 hydrogenated castor oil | 3.00 | 3.00 |
| Ethylhexylglycerine (octoxyglycerine) | 0.80 | 0.80 |
| Ethanol | 40.00 | 40.00 |
| Citrate buffer | 0.50 | 0.50 |
| 1,2-hexanediol/1,2-octanediol (1:1) | — | 0.35 |
| Phenoxy ethanol | 0.25 | 0.35 |
| Triclosan ® (5-chloro-2-(2,4-dichlorophenoxy)phenol) | 0.25 | — |
| 2-benzylheptane-1-ol (Jasmine oil) | — | 0.15 |
| Perfume oil AE from example 2 | 0.50 | — |
| Perfume oil MF from example 3 | — | 0.75 |
| Water | To 100 | To 100 |

EXAMPLE 3.6

Antiperspirant Sticks

| Component | % by weight | % by weight |
|---|---|---|
| Phenyl trimethicone (SilCare TM Silicone 15 M 50) | 13.50 | 13.50 |
| Cetearyl alcohol | To 100 | To 100 |
| Cetiol CC (dicaprylyl carbonate) | 13.50 | 13.50 |
| Stearic acid | 3.50 | 3.50 |
| PEG-40 hydrated castor oil (Emulsogen TM HCO 040) | 4.10 | 4.10 |
| PEG-8 distearate (Cithrol 4 DS) | 4.10 | 4.10 |
| Petrolatum | 6.90 | 6.90 |
| Aluminum hydrochloride | 13.80 | 13.80 |
| Aluminum zirconium trichlorohydrex gly | 20.00 | 19.50 |
| Neo Heliopan ® Hydro (UV-filter: PhenylNCl: benzimidazole sulfonic acid) | 2.00 | — |
| 2,2-dimethyl-3-phenylpropanol (muguet alcohol) | — | 0.15 |
| Ethylhexyl glycerine (octoxyglycerine) | 0.35 | 0.25 |
| Perfume oil AE from example 2 | 1.25 | — |
| Perfume oil MF from example 3 | — | 1.00 |

EXAMPLE 3.7

Alcohol-Based Deodorant Aerosol Spray

| Component | % by weight | % by weight |
|---|---|---|
| Octyldodecanol | — | 0.50 |
| 2-butyl decanoic acid | — | 0.45 |
| 2-hexyl decanoic acid | 0.50 | — |
| 1,2-pentanediol | 1.00 | 2.00 |
| 1,2-hexanediol | 0.25 | 0.20 |
| 1,2-octanediol | — | 0.20 |
| Farnesol | 0.15 | — |
| 2-methyl-5-phenylpentan-1-ol (Rosaphen) | 0.10 | — |
| 4-methyl-4-phenyl-2-pentanol (Vetikol) | — | 0.25 |
| Ethylhexylglycerine (octoxyglycerine) | 0.25 | 0.50 |
| Phenoxyethanol | 0.25 | — |
| Perfume oil AE from example 2 | 0.80 | — |
| Perfume oil MF from example 3 | — | 1.25 |
| Ethanol | To 100 | To 100 |

The liquid mixture obtained following the mixing together of the respective components indicated is filled with a propane-butane mixture (ratio of quantities 2:7) in a ratio of 2:3 in an aerosol container.

EXAMPLE 3.8

Antiperspirant Spray

To a mixture of suitable carriers comprising 12.5 parts by weight Miglyol 840 Gel B (mixture of propylene glycoldicaprylate/-dicaprate, stearalkonium hectorite and propylene carbonate; producer: Sasol), and 46.5 parts by weight silicone oils (cyclomethicone, dimethiconol; producer: Dow Corning), 40 parts by weight of aluminum hydrochloride are added. Once the mixture has become homogenous, 1.8 parts by weight of the perfume oil MF from example 3 are added. From 1 part by weight of the resultant solution and 3 parts by weight of a propellant gas (propane/butane; pressure 2.5 to 2.7 bar) an aerosol spray is produced, which is used as an antiperspirant spray on a number of test subjects to combat the odor of underarm sweat.

EXAMPLE 4

Hair Dye Products Containing Perfume Oils According to the Invention

Perfume Oils:

| | Perfume oil HF (according to the invention) | Perfume oil HD (comparison) |
|---|---|---|
| 3-octanone | 1.00 | 1.00 |
| Cis-3 hexenol | 12.00 | 12.00 |
| Vertocitral ® | 4.00 | 4.00 |
| Rhubafurane | 1.00 | 1.00 |
| Styralyl acetate | 5.00 | 5.00 |
| Melonal ® | 4.00 | 4.00 |
| Dihydromyrcenol | 100.00 | 100.00 |
| Citronitrile | 5.00 | 5.00 |
| Brazilian orange oil | 60.00 | 60.00 |
| Oxania base | 15.00 | 15.00 |
| Lavandin Grosso | 10.00 | 10.00 |
| Ethyl acetate | 5.00 | 5.00 |
| Isoamyl acetate | 9.00 | 9.00 |
| Prenyl acetate | 18.00 | 18.00 |
| Benzyl isobutyrate | 10.00 | 10.00 |
| Ethyl butyrate | 8.00 | 8.00 |
| Isoamyl butyrate | 8.00 | 8.00 |
| Aldehyde C14 so-called | 15.00 | 15.00 |
| Ethyl-2-methyl butyrate | 10.00 | 10.00 |
| Manzanate ® | 3.00 | 3.00 |
| Allyl cyclohexyl propionate | 10.00 | 10.00 |
| Ethyl maltol, 1% in DPG | 3.00 | 3.00 |
| 1:1 mixture of cis- and trans-3-methyl-γ-decalactone | 4.00 | 4.00 |
| Vertomugal ® | 7.00 | 7.00 |
| Linalool | 60.00 | 60.00 |
| Dimethyl benzyl carbinyl butyrate | 10.00 | 10.00 |
| Phenirat ® | 90.00 | 90.00 |
| Geraniol | 30.00 | 30.00 |
| Ethyl safranate | 1.00 | 1.00 |
| Diphenyl oxide | 5.00 | 5.00 |
| Benzyl acetate | 30.00 | 30.00 |
| Cyclohexyl salicylate | 15.00 | 15.00 |
| Parmanyl ® | 6.00 | 6.00 |
| Beta-ionone | 20.00 | 20.00 |
| Isoraldeine ® 70 | 30.00 | 30.00 |
| Iris nitrile, 10% in DPG | 3.50 | 3.50 |
| Anethol | 1.00 | 1.00 |
| Agrumex ® HC | 95.00 | 95.00 |
| Oryclon | 120.00 | 120.00 |
| Herbaflorat ® | 30.00 | 30.00 |
| Timberol ® (1-(2,2,6-trimethylcyclohexyl)hexan-3-ol) | 1.50 | 1.50 |
| Sandranol ® | 10.00 | 10.00 |
| Macrolide ® (15-cyclopentadecanolide) | 15.00 | 15.00 |
| Hex-5-enyl-2-methyl butyrate | 20.00 | — |
| Dipropylene glycol | 80.00 | 100.00 |
| TOTAL: | 1000 | 1000 |

EXAMPLE 4.1

Permanent Hair Dye Containing Perfume Oil HF

| | % by weight |
|---|---|
| Component A - Hair dye base | |
| Sodium myreth sulfate (e.g. Texapon K14 S/K, Cognis) | 2.80 |
| Linoleamidopropyl PG-dimonium chloride phosphate (Arlasilk Phospholipid EFA, Uniqema) | 1.00 |
| Caprylyl-/capryl glucoside (Plantacare 810 UP, Cognis) | 2.00 |
| Sodium laureth-6 carboxylate (Akypo Soft 45 NV, Kao) | 10.00 |
| Cetearyl alcohol | 8.00 |
| Octyldodecanol | 1.00 |
| Ceteareth-12 | 0.50 |
| Ceteareth-20 | 0.50 |
| KOH, 50% ig in water | 0.70 |
| Toluene-2,5-diamine sulfate (oxidation dye) | 0.90 |
| Resorcin | 0.20 |
| m-amino phenol | 0.06 |
| 4-chlororesorcin | 0.15 |
| Ascorbic acid | 0.10 |
| Sodium sulfite | 0.15 |
| Ammonia, 25% in water | 6.00 |
| Etidronic acid | 0.20 |
| Polyquaternium-2 (Mirapol A15, Rhodia) | 0.20 |
| Perfume oil HF from example 4 | 0.30 |
| Water | 65.24 |
| Component B - Developer | |
| Cetostearyl alcohol | 8.00 |
| Ceteareth-20 | 2.50 |
| Steartrimonium chloride (Dehyquart B, Cognis) | 1.00 |
| 2,6-dicarboxypyridine | 0.10 |
| Paraffin oil (mineral oil) | 0.30 |
| Etidronic acid | 0.40 |
| Propylene glycol | 0.40 |
| Sodium benzoate | 0.04 |
| Hydrogen peroxide, 50% in water | 12.00 |
| KOH, 50% in water, added until pH-is 3.5 | q.s. |
| Water | To 100 |

Hair dye base (component A) according to the invention and developer (component B) are mixed together in a ratio by weight of 1:1 by stirring and applied to the hair to be dyed.

EXAMPLE 4.2

Permanent Hair Dye Containing Perfume Oil HF

| | % by weight |
|---|---|
| Component A - Hair dye base | |
| p-Phenylene diamine | 0.63 |
| N,N-Bis (2-hydroxyethyl)-p-phenylene diamine sulfate | 0.11 |
| Resorcin | 0.50 |
| 1-naphthol | 0.04 |
| m-Aminophenol | 0.07 |
| Ethanolamine | 3.00 |
| Ammonium hydroxide, 27.5% in all | 9.00 |
| Oleic acid | 12.50 |
| Isoascorbic acid | 0.20 |
| Sodium sulfite | 0.50 |
| Ethoxydiglycol | 5.00 |
| Sorbitol | 0.80 |
| Dulse extract (*Hypnea musciformis*) | 0.10 |
| Oleth-20 | 1.00 |
| Steareth-21 | 0.70 |

-continued

| | % by weight |
|---|---|
| Emulsifying wax | 2.00 |
| Limnanthes alba oil | 0.75 |
| Polyquaternium-10 | 0.20 |
| Polyquaternium-28 | 0.50 |
| Hydrolysed wheat protein | 0.50 |
| Oleyl alcohol | 0.40 |
| Cetearyl alcohol | 4.00 |
| Na-EDTA, 38% ig in water | 0.80 |
| Ammonium lauryl sulfate, 28% in water | 2.00 |
| Titanium dioxide | 0.10 |
| Mica | 0.20 |
| Benzene sulfonic acid-3-(2H-benzotriazol-2-yl)-4-hydroxy-5-(methylpropyl)-monosodium salt (Tinogard HS, Ciba) | 0.20 |
| Buteth-3 | 0.30 |
| Tributyl citrate | 0.50 |
| Perfume oil HF from example 4 | 1.25 |
| Water | 52.15 |
| Component B - Developer | |
| Methyl paraben | 0.05 |
| EDTA | 0.02 |
| Paraffin oil (mineral oil) | 0.60 |
| Cetearyl alcohol | 3.80 |
| Ceteareth-20 | 1.15 |
| Cyclomethicone/Trimethylsiloxysilicate (1:1) | 0.01 |
| Trimethylsilylamodimethicone/C11-C15 Pareth-7/C12-C16 Pareth-9/Trideceth-12/Glycerine/Water (20:6:4:2:3:65) | 2.00 |
| Disodium phosphate | 0.03 |
| Phosphoric acid | 0.02 |
| Hydrogen peroxide, 35% in water | 22.50 |
| Steareth-10 allyl ether acrylate copolymer | 0.10 |
| Water | 69.72 |

Hair dye base (component A) according to the invention and developer (component B) are Mixed together in a ratio by weight of 1:1 by stirring and applied to the hair to be dyed.

EXAMPLE 5

Air Freshener 5 g Accurel (porous homo-polypropylene powder with a 75% hollow content, a product of Akzo Nobel Faser AG, Obernburg, Germany) are loaded with mit 15 g of the perfume oil MF from example 3 by mixing both components under a vacuum. The resultant powder is then stirred at normal pressure with 4.5 g water (mix 1). In a separate vessel 2.5 g carrageenan, 0.3 g chloroacetamide and 0.5 g calcium chloride dihydrate are dissolved in 62 g water whilst heating to a maximum of 75° C. Mix 1 is then stirred into this solution and homogenized. The resulting, preferably still warm, mixture is cast into the desired form (spheres, hemispheres, cushions, cylinders, blocks, cubes, shells or similar). Following cooling to approximately 20° C. air fresheners in gel form are obtained, the loading with perfume oil MF of which is approximately 20% by weight with reference to the total weight of the air freshener.

EXAMPLE 6

Fabric Conditioner

The perfume oil compositions according to the invention from examples 2, 3 and 4 are each incorporated separately in a dose of 0.5% by weight in a fabric conditioner base with the following composition (data in % by weight):

| | |
|---|---|
| Quaternary ammonium methosulfate (esterquat), approx. 90% (e.g. Rewoquat WE 18, Fa. Witco Surfactants GmbH) | 5.5% |
| Alkyl dimethyl benzyl ammonium chloride, approx. 50% | 0.2% |
| (e.g. Preventol R50, Fa. Bayer AG) dye solution, approx. 1% | 0.3% |
| Water | 94.0% |

The pH of the fabric softener base is in the range 2-3. Two cloths are rinsed with 370 g of a 1% aqueous fabric softener solution in a line test machine using the fabric conditioning program for 30 minutes at 20° C. The cloths are wrung out and then spun dry for 20 seconds. One cloth is shrink wrapped while wet and the other hung out to dry. Then both cloths are assessed for smell by a panel.

EXAMPLE 7

Washing Powder

The perfume oil compositions according to the invention from examples 2, 3 and 4 are each incorporated separately in a dose of 0.3% by weight in a washing powder base with the following formulation (all data in % by weight):

| | |
|---|---|
| Linear Na-alkyl benzene sulfonate | 8.8% |
| Ethoxylated fatty alcohol C12-18 (7 EO) | 4.7% |
| Na soap | 3.2% |
| Defoamer DOW CORNING(R) 2-4248S POWDERED ANTIFOAM | |
| Silicon oil on Zeolith X as carrier | 3.9% |
| Zeolith A | 28.3% |
| Na carbonate | 11.6% |
| Na salt of a copolymers of acrylic and maleic acid (Sokalan CP5) | 2.4% |
| Na silicate | 3.0% |
| Carboxymethyl cellulose | 1.2% |
| Dequest 2066 ([[(Phosphonomethyl)imino]bis[(ethylenenitrilo)bis (methylene)]]tetrakis-phosphonic acid, sodium salt) | 2.8% |
| Optical brightener | 0.2% |
| Na sulfate | 6.5% |
| Protease | 0.4% |
| Sodium perborate tetrahydrate | 21.7% |
| Odoriferous substance with rose smell | 0.3% |
| TAED | 1.0% |

Two cloths are washed with 370 g of a 1% aqueous washing powder solution (the pH of the washing powder solution is decisively in the basic range) in a line test machine in the main washing cycle for 45 minutes at 60"C. The cloths are then rinsed for 5 minutes with cold water, wrung out and then spun dry for 20 seconds. One cloth is shrink wrapped while wet and the other hung out to dry. Then both cloths are assessed for smell by a panel.

EXAMPLE 8

Deodorant Sticks

The perfume oils according to the invention from examples 2, 3 and 4 are each incorporated separately in a dose of 0.25% by weight in the following deodorant stick formulation:

| | % by weight |
|---|---|
| Sodium stearate | 8.00 |
| 1,2-hexandiol | 0.25 |
| 1,2-octandiol | 0.25 |
| 1,2-propylene glycol | 41.00 |
| Butylene glycol | 5.00 |
| 2-hexyldecanoic acid | 0.50 |
| Polyethylene glycol(25)cetearyl ether | 3.00 |
| Ethanol | 18.00 |
| Perfume oil from example 2, 3 or 4 | 0.25 |
| Water | To 100 |

In summary the perfumers describe the positive effect of the perfume oils containing hex-5-enyl-2-methyl butyrate as follows:

a) smell: a fresh-green olfactory impression with exotic fruitiness, making the head note of the examples more vibrant and expressive and influencing the impression of fruit in a modern, complex and exotic fashion (i.e. from a perfumistic point of view there is a novel effect);

b) physically: powerful head note in all media tested; good spatial effect (in particular for air fresheners), good effect when used on the hair (in particular shower gel and shampoo:blooming) and from water. Furthermore, a good covering up of the smell of ammonia is found when used in permanent hair dyes, in particular when incorporated in the hair dye base.

The invention claimed is:

1. A method of conveying, modifying, and/or intensifying fragrance notes comprising incorporating into a fragrance substance preparation a compound of formula (I)

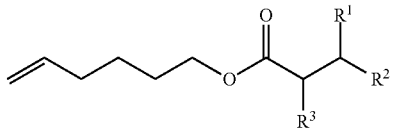

(I)

wherein in formula (I):

$R^1$ is hydrogen and $R^2$ and $R^3$ are in each case methyl wherein the compound of formula (I) is used in a quantity which is sufficient in the fragrance substance preparation to convey, modify and/or intensify one or both of the fragrance notes fruity and green.

2. The method as claimed in claim 1, comprising incorporating one or more compounds of formula (I) and conveying, modifying, and/or intensifying one or both, of the fragrance notes fruity and green.

3. The method as claimed in claim 1, comprising incorporating one or more compounds of formula (I) and conveying, modifying, and/or intensifying fragrance notes of the exotic fruit type.

4. A fragrance substance preparation comprising one or more compounds of formula (I)

(I)

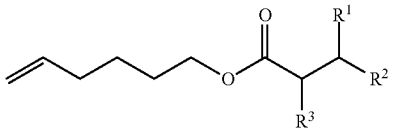

wherein $R^1$ is hydrogen and $R^2$ and $R^3$ are methyl;
and one or more further fragrance substances,
wherein the following mixtures are excluded:
- mixtures containing larval secretion of *Chrysomela lapponica* with *Betula pendula* or *Salix fragillis* as the host plant or identically composed preparations in absolute diethyl ether;
- mixtures containing larval secretions of the *Chrysomela lapponica* with *Betula pendula* or *Salix fragillis* as the host plant or identically composed preparations in absolute diethyl ether with the addition of $LiAlH_4$;
- solutions or extracs of larval secretions of the *Chrysomela knabi, Chrsysomela walshi, Chrysomela falsa* or *Chrysomela* sp with *Salix caprea* as the host plant or identically composed preparations in n-hexane;
- solutions or extracts of larval secretions of the *Chrysomela mainensis interna* with *Alnus rugosa* as the host plant or identically composed preaparations in n-hexane;
- mixtures whose composition is identical to one of the following larval secretions:
  - larval secretions of the *Chrysomela lapponica* with *Betula pendula* or *Salix fragillis* as the host plant
  - larval secretions of the *Chrysomela knabi, Chrsysomela walshi, Chrysomela falsa* or *Chrysomela* sp with *Salix caprea* as the host plant
  - larval secretions of the *Chrysomela mainensis interna* with *Alnus rugosa* as the host plant, and wherein the quantity of the compound of formula (I) is sufficient to convey, modify and/or intensify one, or both, of the fragrance notes fruity and green.

5. The fragrance substance preparation according to claim 4, wherein the fragrance substance preparation contains a quantity of compounds of formula (I) of between 0.01 and 65% by weight in relation to the total quantity of the fragrance substance preparation.

6. The fragrance substance preparation as claimed in claim 5 wherein the one or more further fragrance substances are selected from the group consisting of:
ethyl methyl butyrate; hexenyl butyrate; ethyl butyrate; methyl methyl butyrate; gamma-hexadecalactone, gamma-octalactone; allyl capronate, thiomenthanone, sulfurol; hexyl isobutyrate; ethyl acetate; isoamyl acetate; isovaleraldehyde; ethyl capronate; furaneol; and 2-methyl-4-propyl-1,3-oxathiane.

7. The fragrance substance preparation as claimed in claim 4 wherein the one or more further fragrance substances are selected from the group consisting of:
ethyl methyl butyrate; hexenyl butyrate; ethyl butyrate; methyl methyl butyrate; gamma-hexadecalactone, gamma-octalactone; allyl capronate, thiomenthanone, sulfurol; hexyl isobutyrate; ethyl acetate; isoamyl acetate; isovaleraldehyde; ethyl capronate; furaneol; and 2-methyl-4-propyl-1,3-oxathiane.

8. A perfumed article comprising a compound of formula (I)

(I)

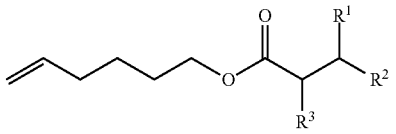

wherein in formula (I):
$R^1$ is hydrogen and
$R^2$ and $R^3$ are in each case methyl;
or a fragrance substance preparation as claimed in claim 4, wherein the perfumed article is selected from the group consisting of: perfume extracts, eau de parfums, eau de toilettes, aftershaves, eau de colognes, pre-shave products, splash colognes, perfumed freshening wipes, perfumes for acid, alkaline and neutral cleaning agents, detergents, washing tables, disinfectants, as well as air fresheners, aerosol sprays, waxes and polishes, and personal hygiene agents, bath oils, cosmetic emulsions, hair care products, deodorants, and antiperspirants, decorative cosmetic products and candles, lamp oils, incense sticks, insecticides, repellents, and propellants.

9. The fragrance substance preparation according to claim 4, wherein the fragrance substance preparation contains a quantity of compounds of formula (I) of between 0.5 and 30% by weight in relation to the total quantity of the fragrance substance preparation.

10. The fragrance substance preparation according to claim 4, wherein the fragrance substance contains a quantity of compounds of formula (I) of between 0.5 and 25% by weight, in relation to the total quantity of the fragrance substance preparation.

11. The fragrance substance preparation as claimed in claim 5 wherein the one or more further fragrance substances are selected from the group consisting
ethyl methyl butyrate; hexenyl butyrate; ethyl butyrate; methyl methyl butyrate; gamma-hexadecalactone, gamma-octalactone; allyl capronate, thiomenthanone, sulfurol; hexyl isobutyrate; ethyl acetate; isoamyl acetate; isovaleraldehyde; ethyl capronate; furaneol; and 2-methyl-4-propyl-1,3-oxathiane.

12. A method of manufacturing a fragrance substance preparation comprising:
mixing of one or more compounds of formula (I)

(I)

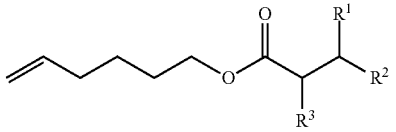

with further fragrance substance(s) and optionally further components of the fragrance substance preparation
wherein in formula (I):
$R^1$ is hydrogen and
$R^2$ and $R^3$ are in each case methyl, and
wherein the compound of formula (I) is used in a quantity which is sufficient in the fragrance substance preparation to convey, modify and/or intensify one or both of the fragrance notes fruity and green.

13. A method of providing (a) hair or (b) textile fibers with one or both the fragrance notes fruity and green comprising applying a fragrance substance preparation as claimed in claim 5 to the (a) hair or (b) textile fibers.

14. A method for providing (a) hair or (b) textile fibers with one or both the fragrance notes fruity and green, comprising:

i) preparing a mixture, containing one or more compounds of formula (I)

(I)

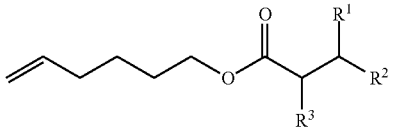

ii) applying the mixture to (a) the hair or (b) the textile fibers wherein in formula (I):

$R^1$ is hydrogen and $R^2$ and $R^3$ are in each case methyl, and wherein the compound of formula (I) is used in a quantity which is sufficient in the fragrance substance preparation to convey, modify and/or intensify one or both of the fragrance notes fruity and green.

15. A method of increasing the substantivity and/or retention of a fragrance substance preparation comprising incorporating into a fragrance substance preparation a compound of formula (I)

(I)

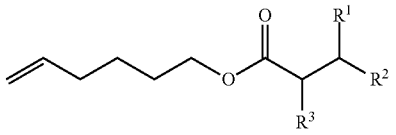

wherein in formula (I):

$R^1$ is hydrogen and $R^2$ and $R^3$ are in each case methyl, and wherein the compound of formula (I) is used in a quantity which is sufficient in the fragrance substance preparation to convey, modify and/or intensify one or both of the fragrance notes fruity and green.

* * * * *